United States Patent [19]

Medlin

[11] Patent Number: 4,577,690

[45] Date of Patent: Mar. 25, 1986

[54] METHOD OF USING SEISMIC DATA TO MONITOR FIREFLOODS

[75] Inventor: William L. Medlin, Dallas, Tex.

[73] Assignee: Mobil Oil Corporation, New York, N.Y.

[21] Appl. No.: 601,465

[22] Filed: Apr. 18, 1984

[51] Int. Cl.[4] ..... E21B 43/243; E21B 47/00

[52] U.S. Cl. ..... 166/251; 166/256

[58] Field of Search ..... 166/251, 250, 256, 259

[56] References Cited

U.S. PATENT DOCUMENTS

| | | | |
|---|---|---|---|
| 2,670,047 | 2/1954 | Mayes et al. | 166/262 |
| 2,803,305 | 8/1957 | Behning et al. | 166/251 |
| 3,379,248 | 4/1968 | Strange | 166/256 |
| 3,399,721 | 9/1968 | Strange | 166/259 |
| 3,470,954 | 10/1969 | Hartley | 166/251 |
| 4,184,548 | 1/1980 | Ginsburgh et al. | 166/251 |

OTHER PUBLICATIONS

Farr, "How Seismic is used to Monitor EOR Projects", *World Oil*, Dec. 1979, pp. 95–102.

*Primary Examiner*—Stephen J. Novosad

*Attorney, Agent, or Firm*—A. J. McKillop; Michael G. Gilman; George W. Hager, Jr.

[57] ABSTRACT

A method for identifying the location of the extent of travel of a combustion front following an in situ oil recovery operation employs a source of seismic energy and at least one seismic receiver for detecting seismic reflection signals from boundaries between subterranean formations on either side or opposite sides of such location. The properties of these seismic reflection signals are changed by the reduction in water saturation in the oil reservoir caused by the drying effect of the combustion front, and any such change is detected as an identification of the location of the extent of travel of the combustion front through the oil reservoir.

3 Claims, 7 Drawing Figures

METHOD OF USING SEISMIC DATA TO MONITOR FIREFLOODS

BACKGROUND OF THE INVENTION

Hydrocarbon liquid, more particularly oil, in many instances can be recovered from a subterranean formation through a well penetrating the formation by utilizing the natural energy within the formation. However, as the natural energy within the formation declines, or where the natural energy originally is insufficient to effect recovery of the hydrocarbon liquid, recovery methods involving addition of extrinsic energy to the formation can be employed. One of these methods, called the in situ combustion method, involves supplying a combustion-supporting gas (i.e., air or oxygen) to the formation and effecting combustion in place within the formation of a portion of the hydrocarbon liquid or of a carbonaceous residue formed from a portion of the hydrocarbon liquid. Downhole heaters and burners may be used for effecting such combustion. A combustion front migrates through the formation. The heat produced by the combustion reduces the viscosity of the hydrocarbon liquid ahead of the front and effects recovery of a greater portion of the hydrocarbon liquid within the formation than would be obtained in the absence of the combustion method. Such in situ combustion method is disclosed in U.S. Pat. Nos. 2,670,047 (Mayes, et al.); 3,379,248 (Strange); 3,399,721 (Strange); and 3,470,954 (Hartley).

SUMMARY OF THE INVENTION

The present invention is directed to a method for identifying the extent of travel of a combustion front through a subterranean oil reservoir from an injection well during or following an in situ combustion operation for the recovery of oil from the reservoir. The change in water saturation in the reservoir caused by the drying effect of the combustion front as it moves through the reservoir is monitored, and the location of the extent of travel of the combustion front from the injection well is identified as that point at which the water saturation drops below residual saturation. This drop in water saturation is detected by a change in the seismic characteristics of the oil reservoir.

More particularly, at least one seismic property of the subterranean oil reservoir is measured at a plurality of horizontally spaced positions from the injection well. The location of the extent of travel of the combustion front from the injection well is identified as lying between two of such horizontally spaced positions when the measured seismic property of the oil reservoir changes between the two horizontally spaced positions. The measured seismic property may include the seismic velocity contrast at an overlying or underlying boundary of the reservoir, the seismic interval velocity through the reservoir, and the attenuation of seismic energy through the reservoir.

A change in seismic velocity contrast is measured by:

(i) detecting the presence of a seismic reflection signal from a first point on an overlying or underlying reservoir boundary which is absent at a spaced apart second point along the overlying or underlying reservoir boundary due to the combustion front having traveled to a location between such first and second points on the overlying or underlying reservoir boundaries, and (ii) detecting the absence of a seismic reflection signal from a first point on an overlying or underlying reservoir boundary which is present at a spaced apart second point along the overlying or underlying reservoir boundary due to the combustion front having traveled to a location between such first and second points on the overlying or underlying reservoir boundaries.

The seismic interval velocity is measured by detecting seismic reflection signals from formation boundaries both above and below the oil reservoir for a plurality of common surface points. The interval thickness between the formation boundaries is divided by half the time difference between the arrivals of the seismic reflection signals at each common surface point. A change in interval velocity between any pair of spaced apart common surface points identifies the location of the extent of travel of the combustion front through the oil reservoir as lying between such pair of common surface points.

With respect to the seismic attenuation property, seismic reflection signals are detected from formation boundaries both above and below the oil reservoir for a plurality of common surface points. The ratio of these reflection signals is taken to provide an attenuation factor for the travel of seismic energy through the reservoir. A change in the attenuation factor between any pair of spaced apart common surface points identifies the location of the extent of travel of the combustion front through the oil reservoir lying between such pair of common surface points.

DESCRIPTION OF THE PREFERRED EMBODIMENT

Figure 1:
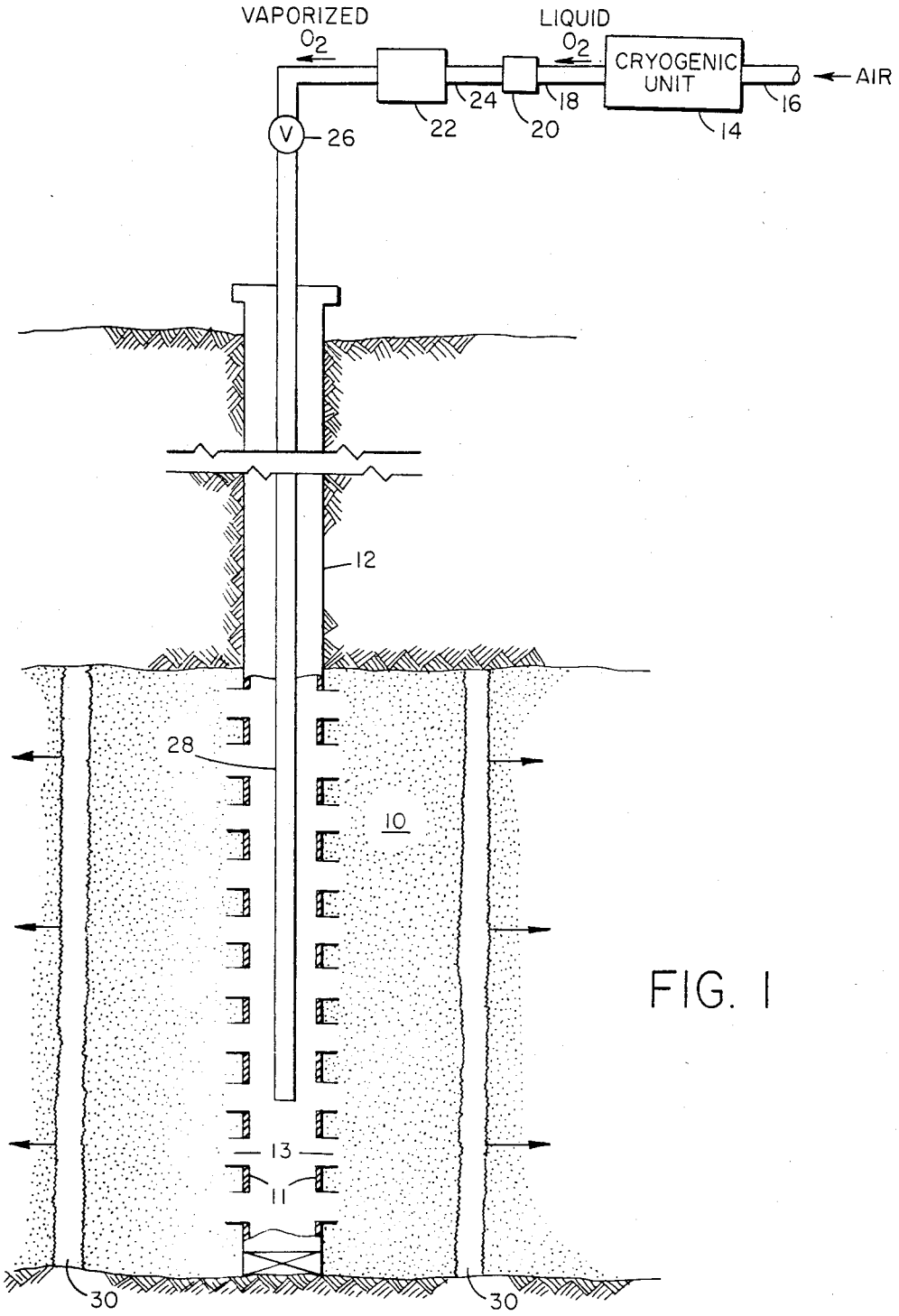
FIG. 1 illustrates an in situ combustion operation with which the method of the present invention is to be utilized.

Referring to FIG. 1, there is shown an injection well 12 penetrating a subsurface oil-bearing reservoir 10. The injection well 12 is in fluid communication with the reservoir 10 by means of perforations 13 in the well casing 11. On the surface, a cryogenic unit 14 for producing liquid oxygen from air is positioned near the injection well 12. Air is introduced into the cryogenic unit 14 through line 16, and the cryogenic unit is operated to produce substantially pure liquid oxygen. A suitable cryogenic unit is the one disclosed in an article by K. B. Wilson entitled "Nitrogen Use In EOR Requires Attention to Potential Hazards," *Oil & Gas Journal,* Vol 80, No. 42, pp. 105–109, 1982, the disclosure of which is hereby incorporated by reference. Liquid oxygen produced by cryogenic unit 14 flows through line 18 and is pumped by cryogenic pump 20 through a heat exchanger 22 via line 24 to vaporize the liquid oxygen. The need to use a compressor conventionally used in an in-situ combustion operation is eliminated, thereby reducing the hazards associated with large-scale mechanical compressors and also reducing energy costs for compression. Vaporized oxygen at a predetermined pressure is introduced into the reservoir 10 through open valve 26 and tubing 28, and the oil in the reservoir is ignited either by autoignition or by any suitable conventional manner such as chemical igniters or heaters. For example, an electric igniter may be positioned in well 12 adjacent the perforations 13 establishing communication with the reservoir 10. One such electric igniter is disclosed in U.S. Pat. No. 2,771,140 to Barclay, et al., which is incorporated herein by reference. The heater is an electric heater capable of heating a portion of the reservoir immediately adjacent to the injection well 12 to a temperature sufficient with the oxygen flowing into the well to result in ignition of the hydrocarbons in the reservoir 10.

Figure 2:
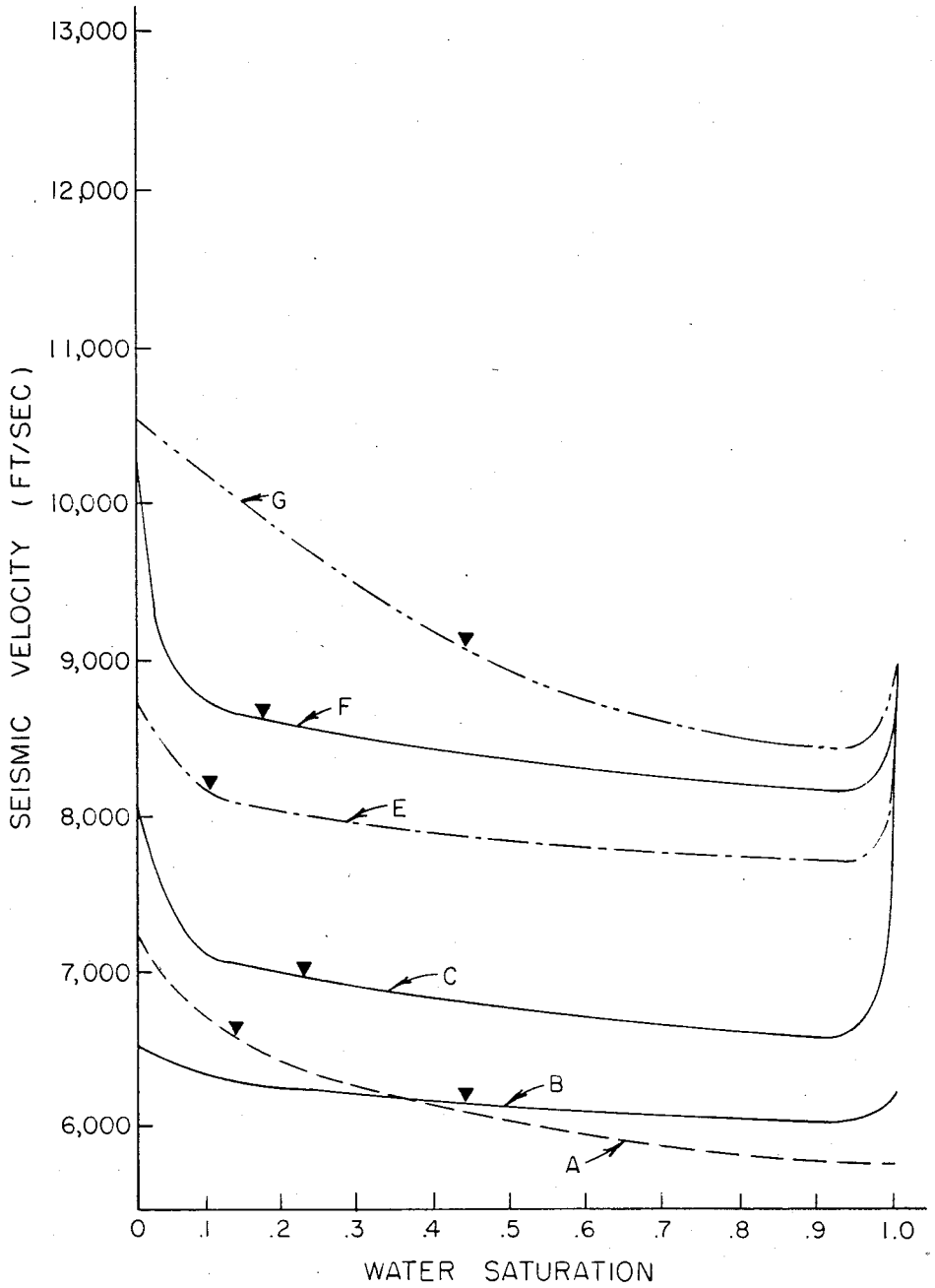
FIGS. 2 and 3 aree graphical representations of the variation in seismic properties with water saturation across a combustion front in an oil reservoir, as shown in FIG. 1.
Figure 3:
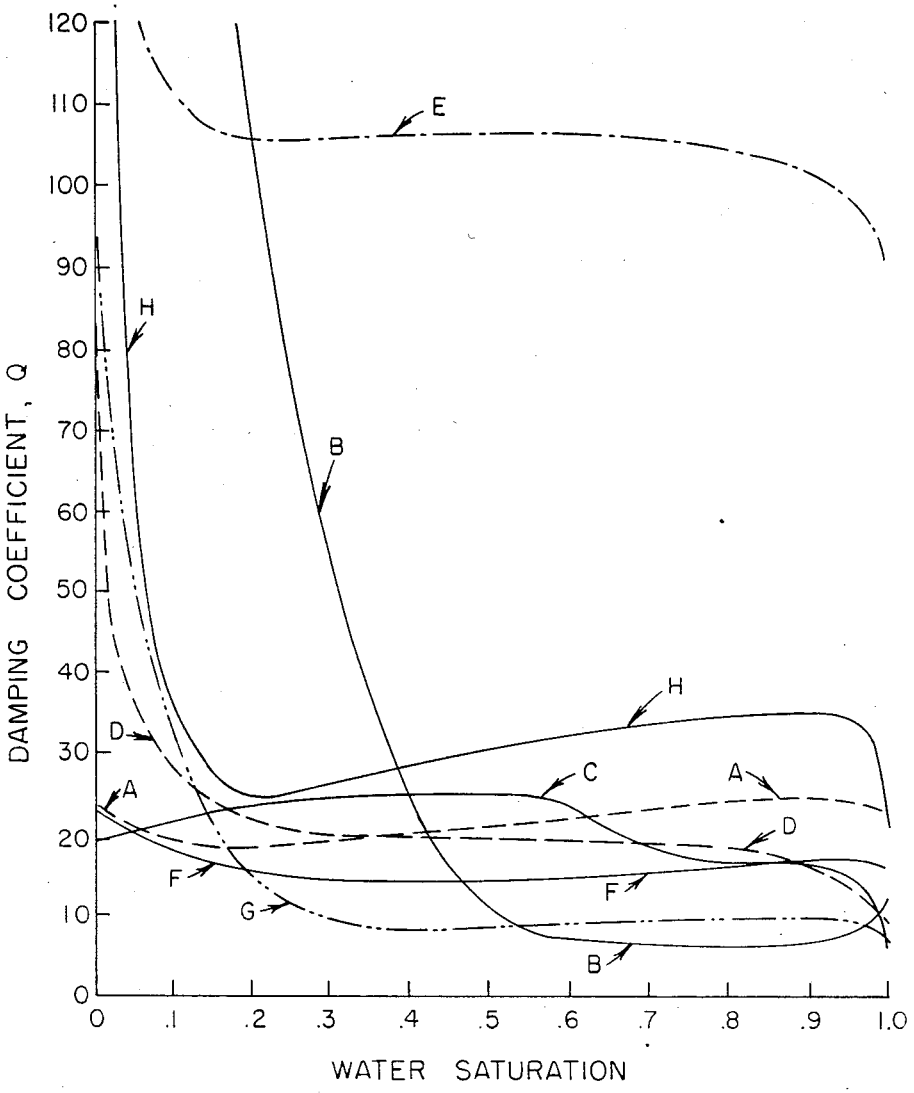

As the combustion front 30 moves through the reservoir 10, it can be expected to significantly reduce the water saturation (i.e., dry out the formation). The portion of the reservoir traversed by the combustion front remains at elevated temperatures, and the reduced water saturation will persist for some time. The elevated temperatures in such portion of the reservoir result from the substantially complete combustion of resident carbonaceous materials and may reach a magnitude of about 1,000° F. In sands containing some clay, a reduction in water saturation below residual water saturation produces important changes in the seismic properties of the reservoir across the combustion front. Normally, sand formations containing clay have a high residual water saturation since clay will hold the water under any flowing production processes. Such a change in the seismic properties of the reservoir across the combustion front can best be described in conjunction with FIGS. 2 and 3. FIG. 2 shows the effect of water saturation on the velocity of seismic waves, while FIG. 3 shows the effect on attenuation of seismic waves as represented by the damping coefficient Q.

Referring to FIG. 2, there is illustrated the effect of water saturation on seismic velocity in a vareiety of reservoir sands A–G. The triangle plotted on each curve indicates residual water saturation as measured by conventional centrifuge methods. All of these sands have at least a 2–3% clay content. All of the curves in FIG. 2 have a common feature. A drop in water saturation below residual water saturation effects a sharp increase in seismic velocity. FIG. 3 shows a similar effect on the damping coefficient Q in a variety of reservoir sands A–H. This water saturation effect on seismic properties of the reservoir is utilized in the method of the present invention to locate the position of the extent of travel of the combustion front into the reservoir from the injection well.

Figure 4A:
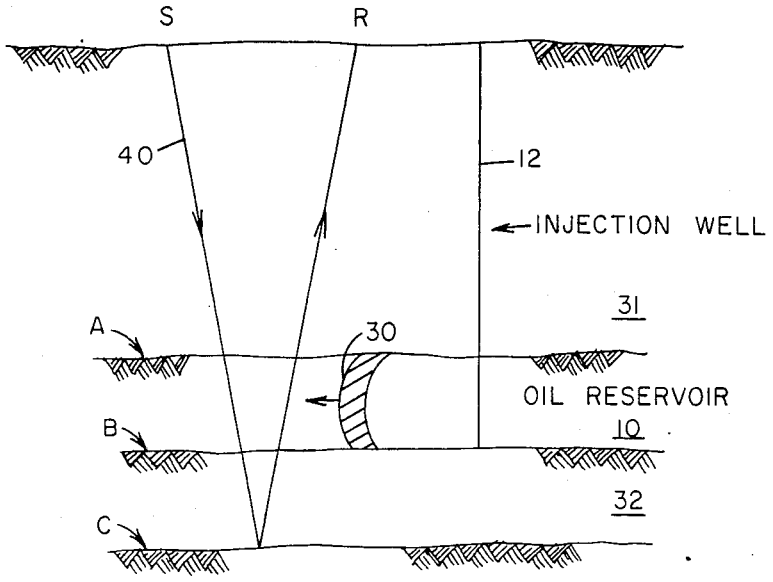
FIGS. 4A, 4B, 5A and 5B illustrate pictorially the seismic reflection signals across the combustion front of FIG. 1 which are to be recorded for identification of the extent of travel of a combustion front through a subsurface oil reservoir in accordance with the method of the present invention.
Figure 4B:
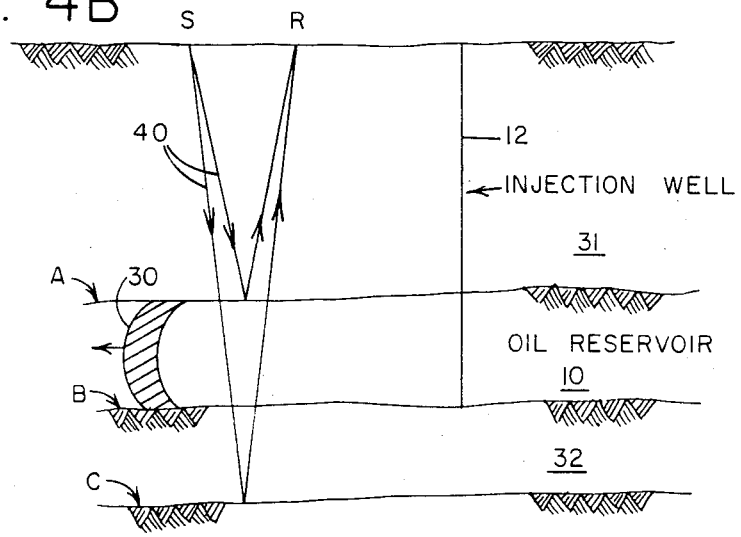

Referring to FIGS. 4A and 4B, there is illustrated the effect on seismic properties of the reservoir as can be predicted from the curves of FIGS. 1 and 2 as the combustion front moves through the reservoir. A seismic energy wave 40 travels into the subsurface formations surrounding the injection well 12 from a source of seismic energy S on the surface of the earth. This seismic energy wave travels through the formations until it comes to a velocity contrast boundary between two subsurface media where reflection occurs. FIG. 4A illustrates the case wherein there is little seismic velocity contrast between the oil reservoir 10 and the overlying medium 31 in front of the combustion front 30. In this case, the seismic energy wave 40 is not reflected to the seismic receiver R until it reaches an underlying reflecting interface caused by a velocity contrast such as illustrated at boundary C in FIG. 4A. However, behind the combustion front 30 there is a large seismic velocity contrast between the oil reservoir 10 and the overlying medium 31 due to the reduction in water saturation in reservoir 10 below residual water saturation due to the drying out of the reservoir upon passage of the combustion front. In this case, there will be a reflection of seismic energy wave 40 at the boundary A as illustrated in FIG. 4B in addition to the one at boundary C as illustrated in FIG. 4A. It is this change in the seismic velocity across the combustion front that is measured by the present invention to identify the particular extent of travel of the combustion front.

Figure 5A:
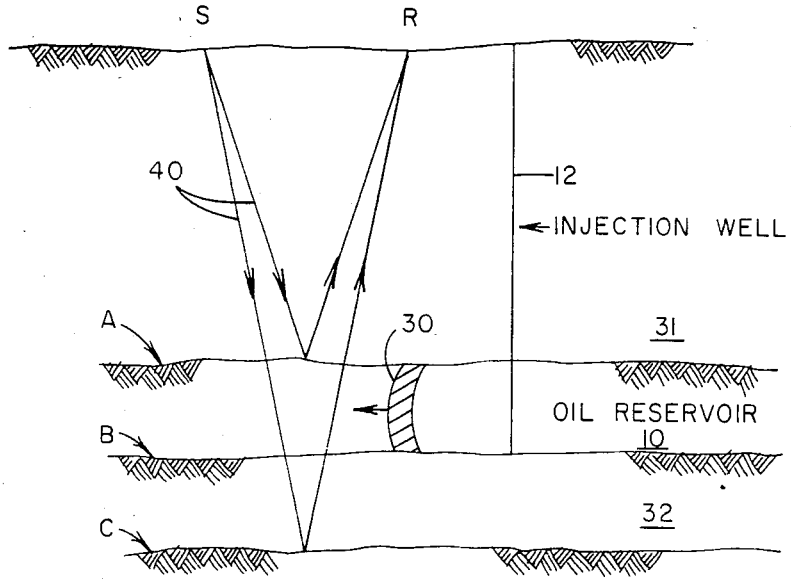
Figure 5B:
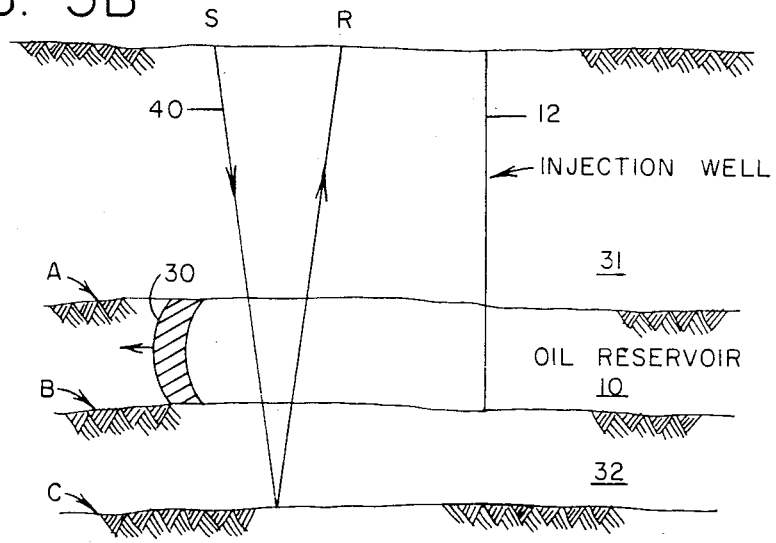

In an alternate case illustrated in FIGS. 5A–5B, the medium 31 overlying the oil reservoir 10 could have a higher seismic velocity initially than that of reservoir 10. This occurs typically in the Gulf Coast areas where thick shales overlie lower velocity gas sands. In this event, the passage of the combustion front raises the seismic velocity in the reservoir 10 to be little different from that of the overlying medium 31. Consequently, the velocity contrast across the combustion front is opposite of that illustrated in FIGS. 4A–4B with the seismic energy wave reflecting from both boundaries A and C in front of the combustion front and reflecting from the lower boundary C behind the combustion front.

In a still alternate case, a seismic velocity contrast may occur between the oil reservoir 10 and the underlying medium 32, thereby causing a seismic reflection from the immediately underlying boundary B either in front of or behind the combustion front. In still other cases, there may be velocity contrasts at both the underlying and overlying boundaries B and A respectively.

It is a specific feature of the present invention to monitor such seismic velocity contrasts at the reservoir boundaries across a combustion front by detecting changes in the reflection times of the seismic energy reflection waves as they travel from the seismic energy source S to the seismic energy receiver R.

Another seismic property which can be monitored as an indication of the position of the combustion front is the seismic interval velocity through the oil reservoir on either side of the combustion front. Referring again to FIG. 4A, both subsurface medium boundaries A and C are illustrated as seismic reflectors. The seismic velocity through the interval A–C is the interval thickness divided by half the time difference between the arrivals of the two reflected seismic energy waves at receiver R. This interval velocity will be higher behind the combustion front than ahead of it. In the event the boundary A is no longer a seismic reflector after passage of the burn front, a reflector lying above the boundary A may be utilized. All that is required is that there be a common reflecting boundary above and below the oil reservoir which is not changed through velocity contrast by the passage of the combustion front. However, the interval velocity effect will be difficult to measure unless the reservoir thickness is large compared to the interval distance between the selected reflecting boundaries and unless the velocity contrast due to formation drying is significant.

A yet further seismic property which can be monitored as an indication of the position of the combustion front is the damping coefficient Q of the oil reservoir which controls the attenuation of the seismic energy waves through such reservoir in accordance with the following expression:

$$A = A_o e^{-2\alpha x} = A_o e^{-\frac{fx}{QV_p}}, \quad (1)$$

where $\alpha$ is an attenuation coefficient for a particular interval,

A is the amplitude of an attenuated wave which had an initial amplitude $A_o$, f is frequency, x is the attenuating interval thickness, and $V_p$ is seismic compressional velocity.

Referring again to FIG. 4A where boundaries A and C are seismic reflectors, the damping coefficient Q is higher behind the combustion front than ahead of it. Consequently, the attenuation factor $A/A_o$ is larger behind the front than ahead of it. As a result, the relative amplitude of the seismic wave reflection from boundary C compared to the seismic wave reflection from boundary A is higher behind the combustion front than ahead of it. Again, the boundary A immediately above the oil reservoir need not be utilized if the passage of the combustion front changes its velocity content. Any other reflecting boundary above the oil reservoir may be utilized.

In accordance with the foregoing, it is seen that the method of the present invention determines the extent to which a combustion front has moved through an oil reservoir from an injection well through a measure of changes in the seismic properties of such oil reservoir effected by a reduction of the water saturation (i.e., drying) as the combustion front moved through the reservoir. Such seismic properties include velocity contrasts at overlying or underlying boundaries of the reservoir, an interval velocity change through the reservoir, and a damping or attenuation of seismic energy waves as they travel through the reservoir.

Having now described the method of the present invention, it is to be understood that various modifications and changes may be made without departing from the spirit and scope of the invention as set forth in the appended claims.

I claim:

1. A method for identifying the extent of travel of a combustion front through a subterranean oil reservoir from an injection well following an in situ combustion operation for the recovery of oil from the reservoir, comprising the steps of:

(a) energizing a source of seismic energy;

(b) receiving seismic reflection signals from boundaries between subterranean formation mediums exhibiting seismic velocity contrasts; and (c) identifying the extent of travel of the combustion front through the oil reservoir from the injection well by detecting (i) the presence of a seismic reflection signal from a first point on an overlying or underlying reservoir boundary which is absent at a spaced apart second point along said overlying or underlying reservoir boundary due to the combustion front having traveled to a location between said first and second points on said overlying or underlying reservoir boundaries, or (ii) the absence of a seismic reflection signal from a first point on an overlying or underlying reservoir boundary which is present at a spaced apart second point along said overlying or underlying reservoir boundary due to the combustion front having traveled to a location between said first and second points on said overlying or underlying reservoir boundaries.

2. A method for identifying the extent of travel of a combustion front through a subterranean oil reservoir from an injection well following an in situ combustion operation for the recovery of oil from the reservoir, comprising the steps of:

(a) energizing a source of seismic energy;

(b) receiving seismic reflection signals from boundaries between subterranean formation mediums exhibiting seismic velocity contrasts;

(c) identifying a first seismic reflection signal from a formation boundary above said oil reservoir and a second seismic reflection signal from a formation boundary below said oil reservoir, said first and second reflection signals having a common surface point;

(d) dividing the interval thickness between the formation boundaries at which said first and second seismic reflection signals occur by half the difference between the time occurrences of said first and second seismic reflection signals to provide a measure of interval velocity through the oil reservoir directly below said common surface point;

(e) repeating steps (c) and (d) at a plurality of spaced apart common surface points along a line extending radially outward from the injection well, and (f) identifying the location of the extent of travel of the combustion front through the oil reservoir as lying between that pair of common surface points for which there is a change in the measured interval velocity.

3. A method for identifying the extent of travel of a combustion front through a subterranean oil reservoir from an injection well following an in situ combustion operation for the recovery of oil from the reservoir, comprising the following steps:

(a) energizing a source of seismic energy;

(b) receiving seismic reflection signals from boundaries between subterranean formation medium exhibiting seismic velocity contrasts;

(c) identifying a first seismic reflection signal from a formation boundary above said reservoir and a second seismic reflection signal from a formation boundary below said reservoir, said first and second reflection signals having a common surface point;

(d) taking the ratio of the amplitudes of said first and second reflection signals to provide an attenuation factor for the travel of seismic energy through said reservoir;

(e) repeating steps (c) and (d) at a plurality of spaced apart common surface points along a line extending radially outward from the injection well; and (f) identifying the location of the extent of travel of the combustion front through the oil reservoir as lying between that pair of common surface points for which there is a change in the measured attenuation factor.

* * * * *